United States Patent [19]

Bodine

[11] Patent Number: 4,621,688

[45] **Date of Patent: * Nov. 11, 1986**

[54] CLAMPING JAW DEVICE FOR WELL SERVICING MACHINE

[76] Inventor: Albert G. Bodine, 7877 Woodley Ave., Van Nuys, Calif. 91406

[ * ] Notice: The portion of the term of this patent subsequent to Feb. 7, 2001 has been disclaimed.

[21] Appl. No.: 571,736

[22] Filed: Jan. 18, 1984

Related U.S. Application Data

[63] Continuation-in-part of Ser. No. 344,626, Feb. 1, 1982, Pat. No. 4,429,743.

[51] Int. Cl.[4] ..... E21B 43/25; F16B 7/00; F16D 1/08

[52] U.S. Cl. ..... 166/75.1; 24/537; 279/1 W; 403/310; 166/177

[58] Field of Search ..... 403/290, 310, 311; 279/1 W, 20, 28; 166/75 R, 77, 77.5, 177, 249, 301; 24/537, 517

[56] References Cited

U.S. PATENT DOCUMENTS

| | | | |
|---|---|---|---|
| 2,089,230 | 8/1937 | Thowless | 403/310 |
| 2,179,955 | 11/1939 | Rawnsley | 403/310 |
| 3,601,429 | 8/1971 | Coski | 403/310 |

FOREIGN PATENT DOCUMENTS

| | | | |
|---|---|---|---|
| 352856 | 5/1922 | Fed. Rep. of Germany | 403/310 |
| 681566 | 10/1952 | United Kingdom | 403/310 |

*Primary Examiner*—Stephen J. Novosad
*Assistant Examiner*—Bruce M. Kisliuk
*Attorney, Agent, or Firm*—Edward A. Sokolski

[57] ABSTRACT

A clamping jaw device is used to couple sonic energy generated by an orbiting mass oscillator to a pipe string for transmission down the string to a downhole work area. The clamping jaw device includes a pair of similar clamping jaws, each forming a half section of a hollow cylinder. The jaw device has a head portion, a main body portion, a neck portion joining the head portion to the main body portion and indented from the head portion and a flange at the bottom end of the main body portion. The pipe string is retained between the jaws by means of a jaw lock member which comprises a flat ring slidably mounted on the main body portion and adjustably positionable therealong, the lock member being seated against the flange at the bottom end of the main body portion to hold the jaws in a closed clamping position against the pipe string. The clamping jaws may be firmly clamped to the pipe string so that sonic energy is delivered thereto throughout the vibration cycle of the oscillator by means of hold down screws.

4 Claims, 8 Drawing Figures

CLAMPING JAW DEVICE FOR WELL SERVICING MACHINE

This application is a continuation-in-part of my application Ser. No. 344,626 filed Feb. 1, 1982, now U.S. Pat. No. 4,429,743, issued 2/7/84.

In my application Ser. No. 344,626, a well servicing system employing sonic energy transmitted down a pipe string is described for use in various well servicing operations, such as liner extraction, perforation cleaning, gravel packing, liquid treatment, etc. In this system, sonic energy available from an orbiting mass oscillator is coupled into the top of a drill pipe for transmission down a drill string to a downhole work area so that the sonic energy is employed to effect the desired operation. A unique clamping jaw device is described for coupling the oscillator and support structure to the top end of the pipe string in a detachable manner. The present invention is directed towards a modified version of this clamping device which more firmly locks the drill pipe to the oscillator structure in a manner such that sonic energy is delivered to the pipe string throughout the vibration cycle even in the absence of a strong upward bias force. Thus, with the above indicated improvement, it is possible to apply bi-directional vibration force to the work area regardless of whether or not a strong upward bias force is present so as to more effectively perform the desired operation.

It is therefore an object of this invention to provide an improved clamping device for removably coupling a sonic oscillator to a pipe string.

It is a further object of this invention to provide a clamping device for coupling a sonic oscillator to a drill string whereby tight coupling is provided such as to enable the application of bi-directional vibration force to the string.

Other objects of the invention will become apparent as the description proceeds FIG. 1 is a side elevational view of a sonic well servicing system employing FIG. 1 is a side elevational view of a sonic well servicing system employing the clamping device of the invenion;

Figure 1:
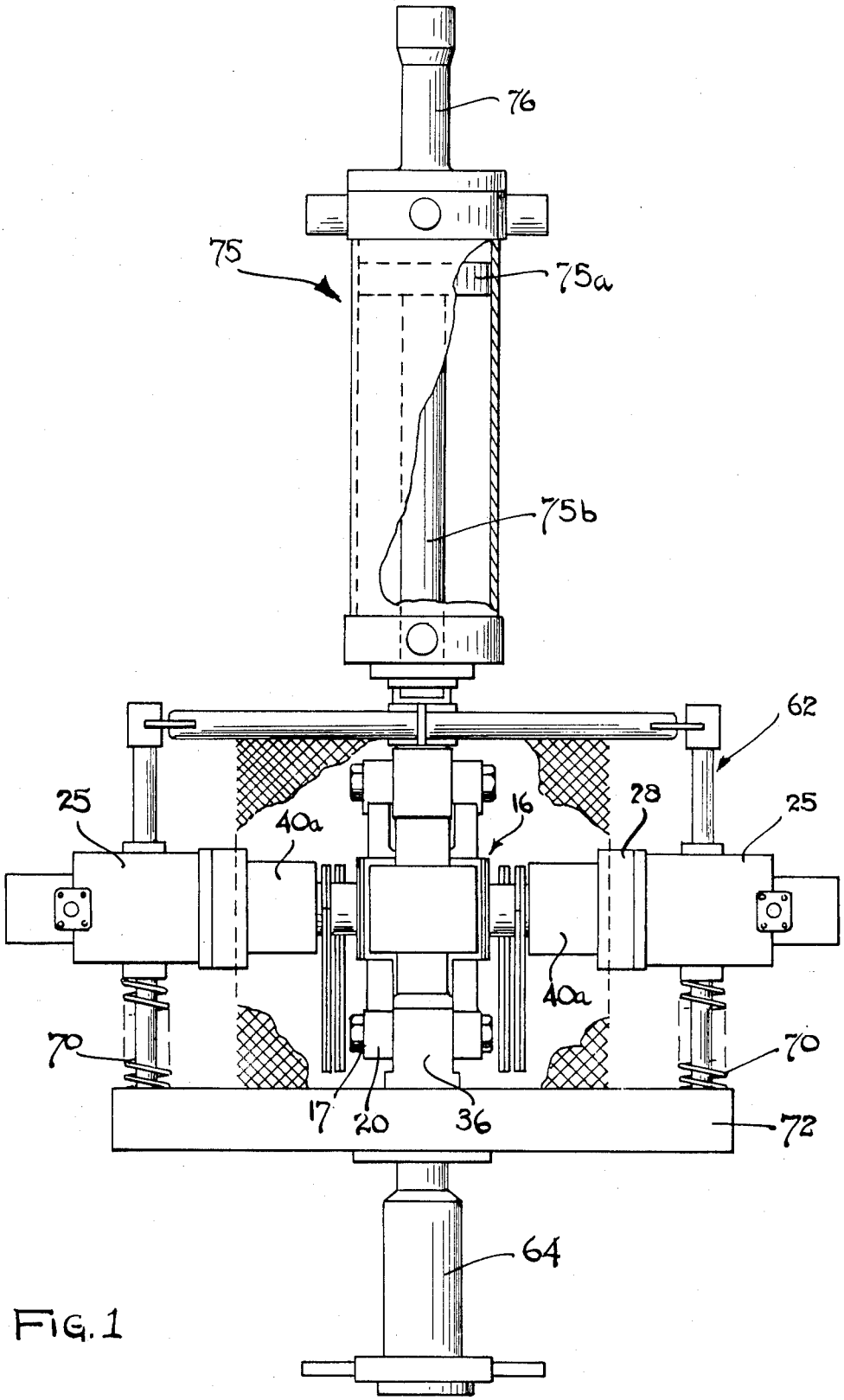
Figure 2:
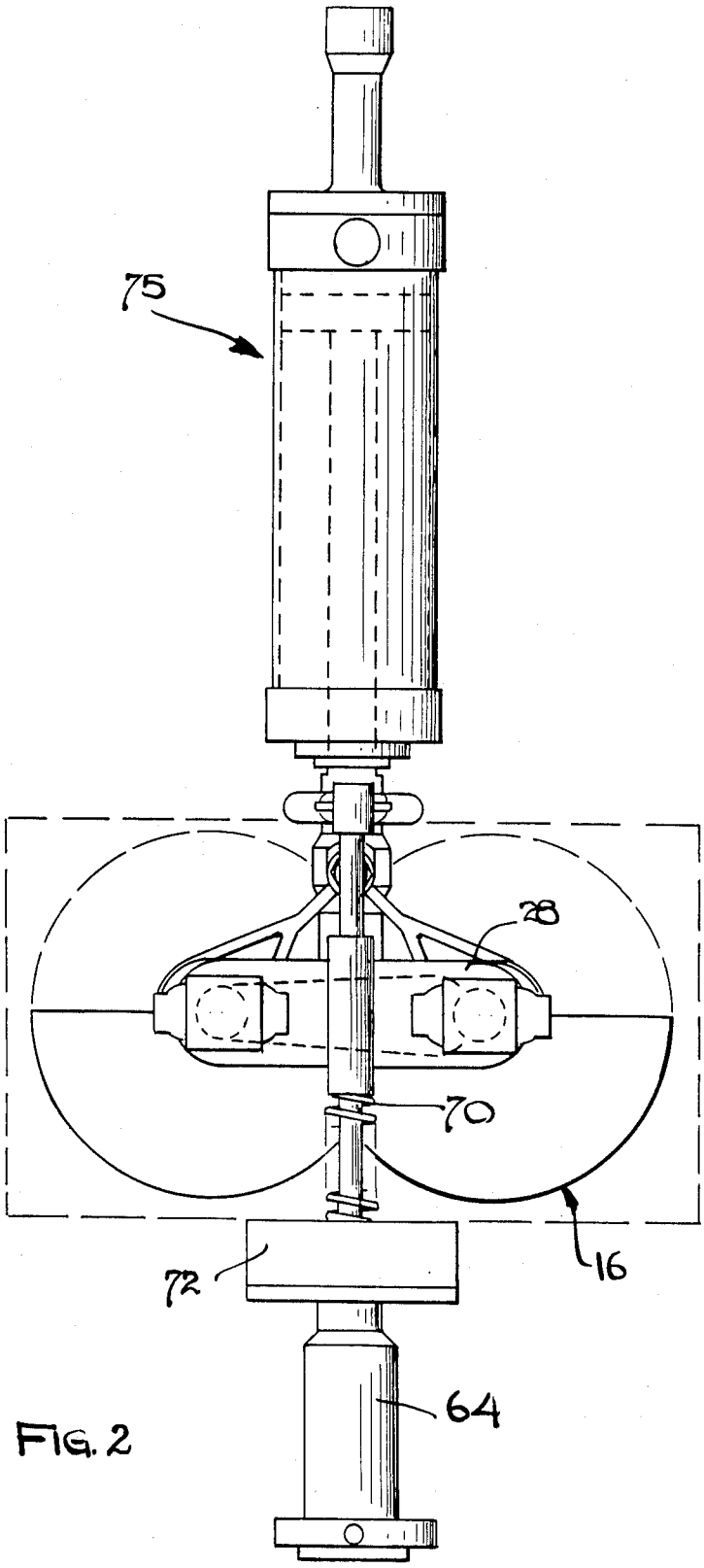
FIG. 2 is an end elevational view of the system of FIG. 1.

Referring to FIGS. 1 and 2, an embodiment of the invention as incorporated in a well servicing machine, as described in my aforementioned application Ser. No. 344,626, (in connection with FIGS. 9–11 thereof) is illustrated. As this system (except for the clamping device of the present invention) is fully described in my aforementioned application, it will be but briefly described herein, the disclosure of my prior application being incorporated herein by reference. In this embodiment, low impedance coupling to the pipe string is achieved by employing a vertically elongated gas accumulator chamber to form a compliant high pressure air spring, as now to be described.

An orbiting mass oscillator 16, as described in my application Ser. No. 344,626 is employed, the frame 20 of this oscillator being tightly coupled to stem 36 by means of bolts 17. Stem 36 is clamped to the top end of the drill string (not shown) by means of clamping jaws 64. Hydraulic motors 25 are coupled to the oscillator 16 through gear box 28 by means of Schmidttype disc couplings 40*a*. The hydraulic motors are supported on base member 72 on spring mounts 70. Support shaft 76 is suspended from a derrick or the like (not shown). Shaft 76 is fixedly attached to air spring cylinder 75, this cylinder having compressed gas therein (typically nitrogen or air). Slidably mounted in cylinder 75 is a piston 75*a* which is carried by the top end of elongated piston rod 75*b*. The bottom end of piston rod 75*b* is fixedly attached to stem 36, as for example, by a suitable threaded connection between the piston rod and the upper end portion of the stem.

In this manner, a long compliant high pressure air spring is provided by the volume of gas underneath piston 75*a*. Thus, a low impedance coupling is afforded between the oscillator and the stem by virtue of the long dimension of the body of gas in the cylinder which provides a low spring rate along with tuning (in force change per unit displacement), even though the static load may be quite high.

Figure 3:
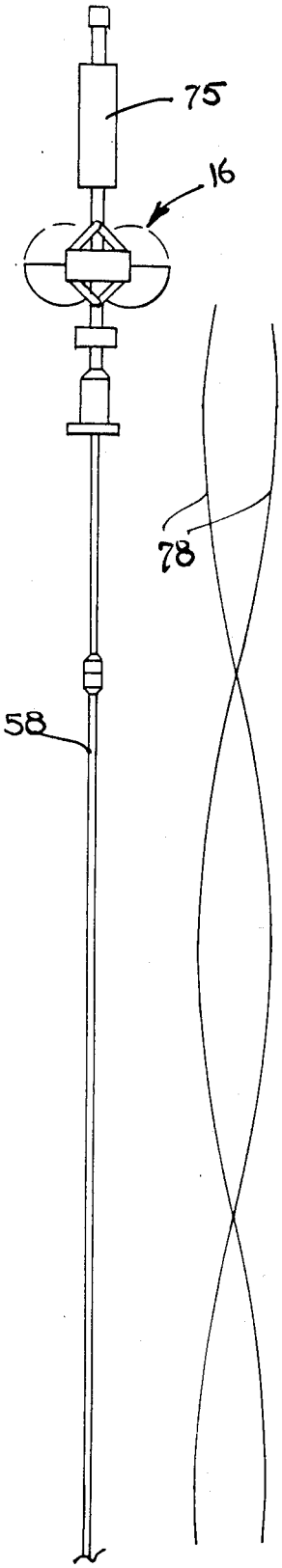
FIG. 3 is a schematic illustration of the system of FIG. 1 showing the low impedance coupling characteristics thereof.

Referring now to FIG. 3, the operation of this embodiment of the invention is schematically illustrated. Wave forms 78 illustrate the standing wave pattern of the vibrational energy along drill string 58 in view of the effects of high pressure elongated air spring 75. As can be seen, an antinode of the vibrational pattern appears at the top end of the drill string in view of the the characteristics of the low impedance coupling provided.

The structure described thus far is fully disclosed in my aforementioned U.S. patent application Ser. No. 344,626. The present invention is directed towards the clamping jaw device 64 and its associated components which will now be described in detail. This clamping jaw assembly enables the convenient attachment and detachment of stem 36 and drill string 58 to and from each other, and at the same time provides a tight coupling between these two elements so that sonic energy is delivered to the drill string throughout the sonic cycle, i.e., in a bi-directional manner, even in the absence of any significant upward bias force.

Figure 4:
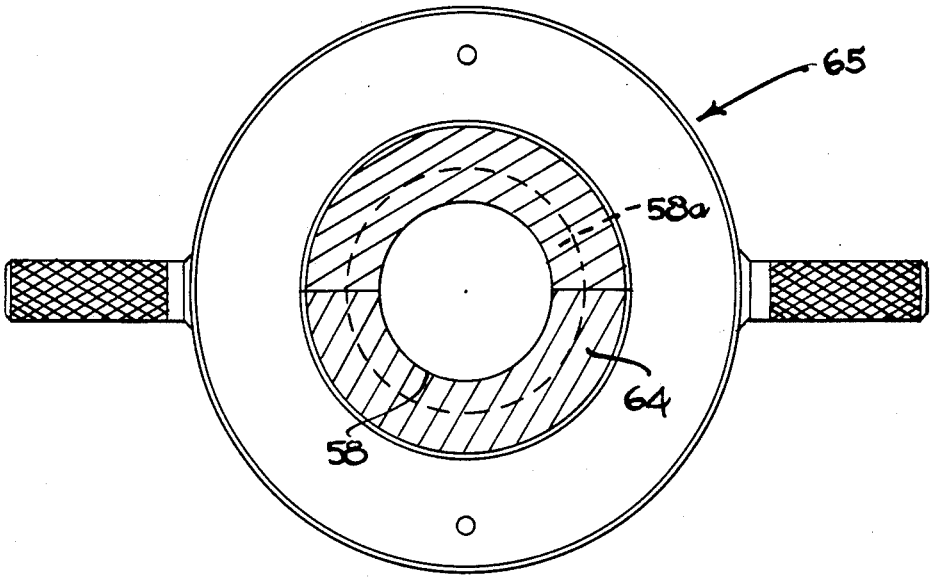
FIG. 4 is a cross-sectional view illustrating the jaw lock member of a preferred embodiment of the clamping device of the invention.
Figure 7:
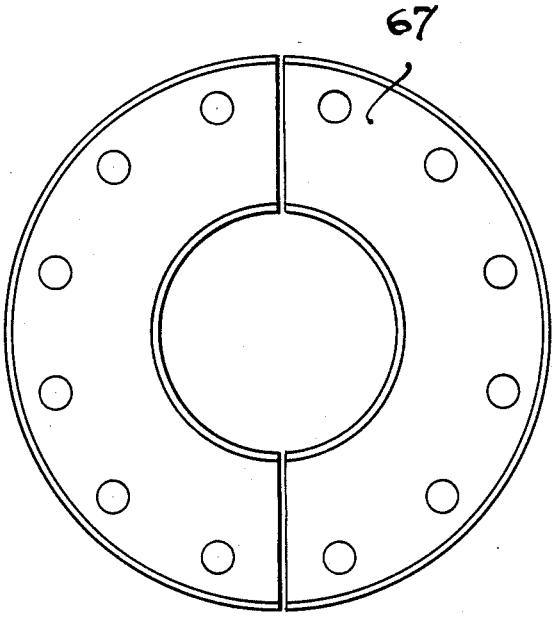
FIG. 7 is a top plan view of a dual section flange plate employed in the preferred embodiment.
Figure 6:
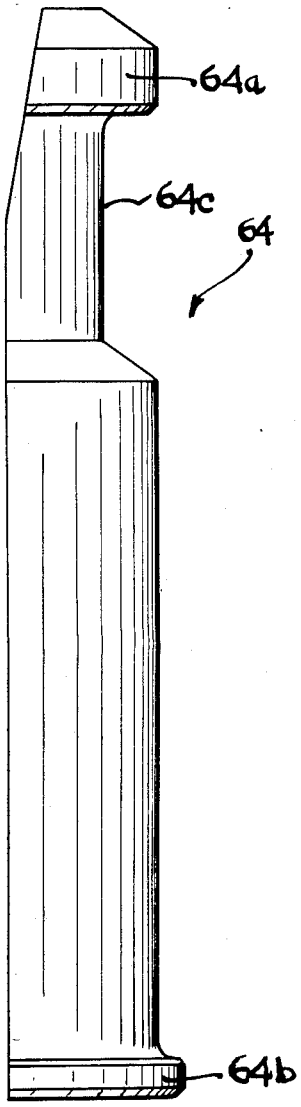
FIG. 6 is an elevational view of one of the clamp jaws employed in the preferred embodiment.

Referring now to FIGS. 5A–7, clamping jaws 64 have similar half sections which are joined together to form a hollow cylinder with the head portions 64*a* of the jaws being retained by means of a ringshaped flange plate assembly 67 which is made in two half sections fitted under head portion 64*a* around indented neck portion 64*c*. Head portion 64*a* is joined to the main body of the jaws by indented neck portion 64*c*. The flange plate is attached to flange 36*a* of stem member 36 by means of bolts and nuts 37. The end of pipe string 58 has a standard tool joint 58*a* attached thereto with a special end plug 58*b* being attached to the remote end of the tool joint. A jaw lock member 65, which can best be seen in FIG. 4, is used to join the jaws 64 to the top end of the pipe string joint. In its installed position, lock member 65 is seated against flange 64*b* at the bottom end of the jaws. Hold down screws 75, which threadably engage stem 36, are tightened down against the top 64*a* of the clamping jaws while screws 76, which threadably engage the clamping jaws, are tightened against hold down plug 58*b*, to firmly retain the clamping jaws to the pipe string.

Figure 5A:
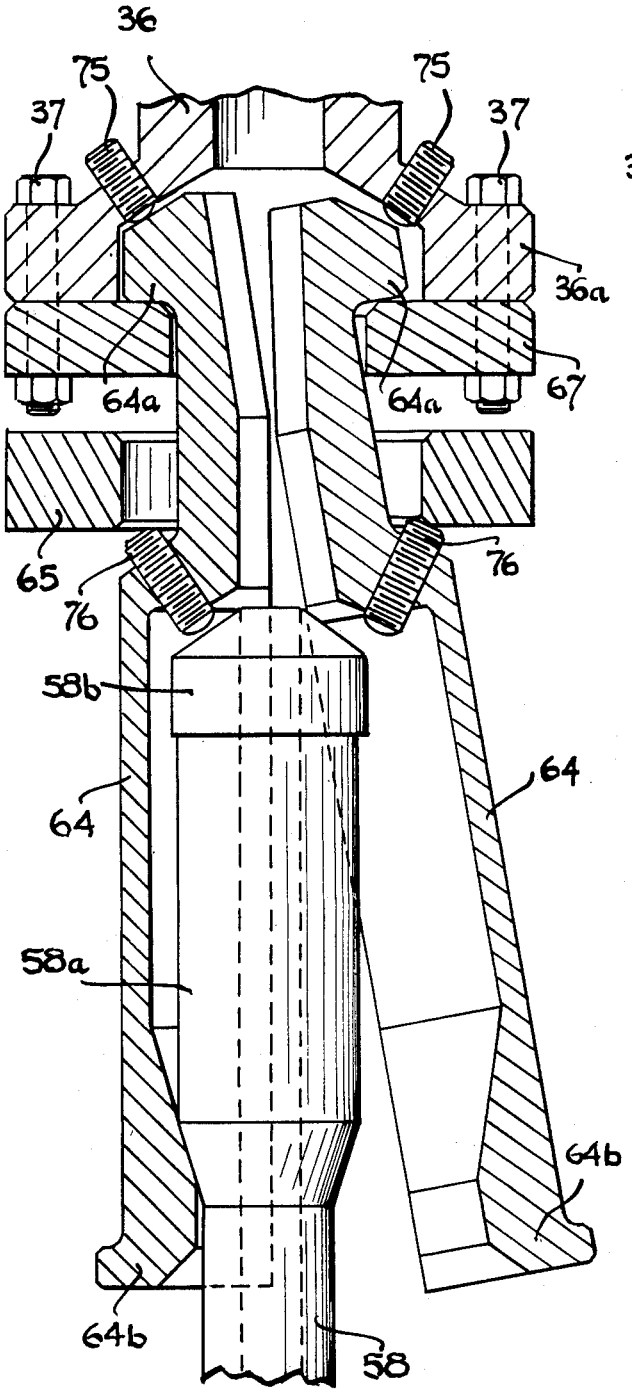
FIG. 5A is an elevational view in cross section illustrating a pipe string being installed in the clamp jaws employed in the preferred embodiment.
Figure 5B:
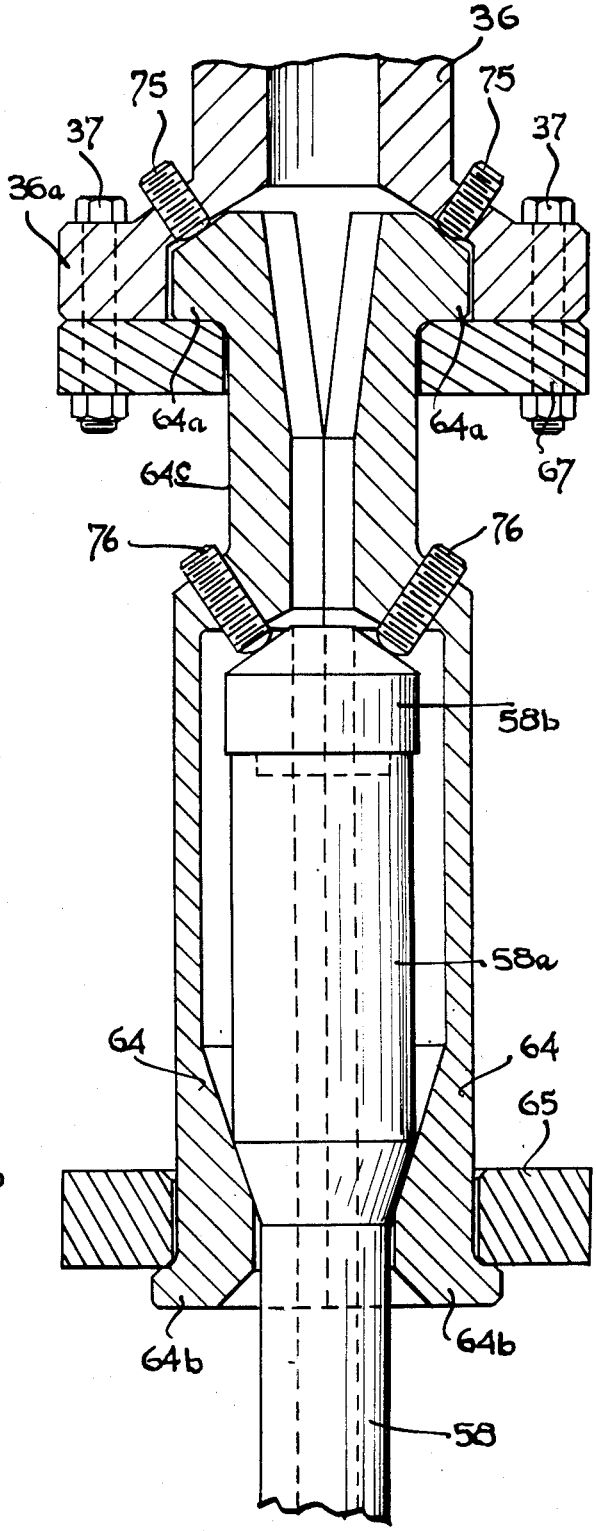
FIG. 5B is an elevational view in cross section illustrating a pipe string fully installed in the clamp jaws.

As can be seen in FIG. 5A, the clamping jaws are clamped to the drill string in the following manner: Jaw lock member 65 is slid up to the top of the jaws, permitting the jaws to be spread apart. The end of the drill string 58, tool joint 58*a* and hold down plug 58*b* are inserted between the jaws as shown. Jaw lock member 65 is then moved down to the bottom of the clamping jaws as shown in FIG. 5B, holding the jaws closed against the drill string, tool joint and hold down plug. Set screws 75 and 76 are then tightened against the clamping jaws and hold down plug respectively to provide a tight coupling between the jaws and the drill string.

While the invention has been described and illustrated in detail, it is to be clearly understood that this is intended by way of illustration and example only and is not to be taken by way of limitation, the spirit and scope of the invention being limited only by the terms of the following claims.

I claim:

1. In a well servicing system for generating and feeding sonic energy down a pipe string to a down hole work area, said system including an orbiting mass oscillator for generating the sonic energy, the improvement being a clamping jaw device for removably coupling the oscillator to the pipe string comprising:

a pair of similar clamping jaws, each of said jaws forming a longitudinal half section of a hollow cylinder and having a head portion, a main body portion, a neck portion indented from said head portion joining the head portion to one end of the main body portion and a flange at the other end of the main body portion, a ring-shaped flange plate assembly fitted under said head portion and around said neck portion, stem member means coupled to said oscillator, said flange plate assembly connecting said jaws to said stem member means, and jaw lock member means for retaining the jaws together in clamping engagement against the top end of the pipe string with said pipe string inserted between the jaws, said jaw lock member means comprising a flat ring member having an inside diameter at least as great as the outside diameter of the main body portion and slidably mounted on the main body portion and adjustably positionable therealong, said jaw lock member means being seated against the flange at the other end of the main body portion to hold the jaws in a closed clamping position against the pipe string.

2. The system of claim 1 wherein said flange plate assembly comprises a pair of similar semi-circular flat plate sections.

3. The system of claim 1 wherein said pipe string has a tool joint attached to the end thereof, said tool joint having an end plug at the remote end thereof, said joint being inserted between the jaws and retained therebetween.

4. The system of claim 3 and further comprising a first set of hold down screws which threadably engage the stem member means and are tightened against the head portion and a second set of hold down screws which threadably engage the main body portion and are tightened against said end plug, thereby firmly clamping the clamping jaws to the pipe string so that sonic energy is delivered to the pipe string throughout the vibration cycle of the oscillator.

* * * * *